US005243954A

United States Patent [19]

Moss

[11] Patent Number: 5,243,954

[45] Date of Patent: Sep. 14, 1993

[54] OXYGEN SENSOR DETERIORATION DETECTION

[75] Inventor: Dennis W. Moss, Waukesha, Wis.

[73] Assignee: Dresser Industries, Inc., Dallas, Tex.

[21] Appl. No.: 993,113

[22] Filed: Dec. 18, 1992

[51] Int. Cl.[5] ..... F02M 51/00

[52] U.S. Cl. ..... 123/688

[58] Field of Search ..... 123/688, 434, 676, 682, 123/690; 364/431.07

[56] References Cited

U.S. PATENT DOCUMENTS

| | | | |
|---|---|---|---|
| 3,938,075 | 2/1976 | Reddy | 123/688 |
| 4,083,338 | 4/1978 | Bertling et al. | 123/688 |
| 4,096,839 | 4/1978 | Niertit | 123/688 |
| 4,099,491 | 7/1978 | Reddy | 123/688 |
| 4,121,548 | 10/1978 | Hattori et al. | 123/688 |
| 4,177,787 | 12/1979 | Hattori et al. | 123/688 |
| 4,364,364 | 12/1982 | Subramaniam | 123/688 |
| 4,417,558 | 11/1983 | Osuga et al. | 123/688 |
| 4,638,783 | 1/1987 | Snyder | 123/688 |
| 4,887,576 | 12/1989 | Inamoto et al. | 123/688 |
| 4,933,863 | 6/1990 | Okano et al. | 123/688 |
| 4,980,834 | 12/1990 | Ikeda et al. | 364/431.05 |
| 5,048,490 | 9/1991 | Nakaniwa | 123/688 |
| 5,052,361 | 10/1991 | Ono et al. | 123/688 |
| 5,054,452 | 10/1991 | Denz | 123/688 |
| 5,065,728 | 11/1991 | Nakaniwa | 123/688 |
| 5,080,072 | 1/1992 | Hosokai et al. | 123/688 |
| 5,115,781 | 6/1992 | Kurita et al. | 123/688 |

*Primary Examiner*—Raymond A. Nelli

*Attorney, Agent, or Firm*—Andrus, Sceales, Starke & Sawall

[57] ABSTRACT

Oxygen sensor deterioration is detected by initially counting the number of fuel units required to change the output voltage of a nondeteriorated sensor between first and second voltages, and subsequently counting the number of fuel units required to change the output voltage of the sensor between the first and second voltages, as the sensor ages, until a subsequent count exceeds the initial count by a given amount. The method detects when the air/fuel ratio desired for normal engine operation drifts outside acceptable tolerance. The method detects and stores a first difference between air/fuel ratios, corresponding to first and second sensor output voltages, and then subsequently detects a second difference between air/fuel ratios, corresponding respectively to the first and second sensor output voltages. When the second difference exceeds the first difference by a given amount, deterioration is indicated.

12 Claims, 3 Drawing Sheets

OXYGEN SENSOR DETERIORATION DETECTION

BACKGROUND AND SUMMARY

The invention relates to the detection of deterioration of an oxygen sensor disposed in the exhaust gas stream of an internal combustion engine.

The invention arose during development efforts directed toward reducing downtime of large, stationary internal combustion engines continuously operated over long intervals. Such engines generate up to thousands of horsepower, and are used in large scale electrical and motive power generation applications, for example utility company power generation, mining and pumping applications, ocean going vessels, and so on. These engines are characterized by extremely long service intervals, as compared to automotive applications. For example, some of such engines have oil change intervals of 5,000 hours. In contrast, a typical automobile driven 100,000 miles has only been in actual operational service for about 2,000 to 3,000 hours.

During the noted long intervals between service on large engines, it is desirable to allow continuous operation, without downtime. Furthermore, the engine should operate within specified tolerances during the entire length of such interval, without drifting from allowable specifications. One of such specifications is that the proper air/fuel ratio be maintained within an allowable tolerance window. Another specification is that exhaust emissions be maintained below a given limit.

The noted large, long interval engines include an oxygen sensor disposed in the exhaust gas stream, for example, as shown in U.S. Pat. No. 4,638,783. The oxygen sensor detects the relative presence of oxygen in the exhaust gases of the engine and generates an output voltage signal which is fed back to a controller controlling the fuel delivery system to ensure that the proper air/fuel ratio is being supplied to the engine, and also to ensure that the proper exhaust gas constituents are transmitted downstream to a catalytic converter for oxidation and reduction. For rich stoichiometric combustion, it is desired to reduce the oxygen content remaining after combustion to near zero: For example, where methane is the fuel, the stoichiometric combustion process is $$CH_4 2O_2 \rightarrow CO_2 + 2H_2O.$$

For rich stoichiometric combustion, the air/fuel ratio mixture supplied to the engine is controlled such that any $O_2$ remaining on the right side of the equation is reduced to near zero. For lean burn combustion, the air/fuel ratio mixture supplied to the engine is controlled such that there is some $O_2$ remaining after combustion.

The oxygen sensor deteriorates as it ages during operation of the engine. This deterioration alters the voltage output characteristic of the sensor. The altered output characteristic in turn provides a different feedback signal to the fuel control or carburetion system which in turn supplies a different air/fuel ratio to the engine. Because of the altered air/fuel ratio, the engine will no longer be operating within the desired tolerance. The altered air/fuel ratio also changes the constituents in the exhaust gas transmitted to the catalytic converter, which then may not fully oxidize and reduce same.

In order to maintain proper engine operation within acceptable tolerances including intake air/fuel ratio, and in order to ensure that the proper exhaust gas constituents are transmitted downstream to the catalytic converter for reduction, it is necessary to periodically check or test the oxygen sensor for deterioration, and to replace the sensor as needed. In the noted large, long interval engines, it is not desirable to periodically shut down the engine, in order to check the oxygen sensor. The downtime is an economic hardship in most applications. It is thus desirable to provide a method for testing the oxygen sensor during engine operation. Various systems have been proposed for testing the oxygen sensor on-line, but are complex and/or costly.

The present invention provides a particularly simple and effective method and system for testing the oxygen sensor on-line.

The present invention employs a standard oxygen sensor known in the prior art, and uses the known output characteristics thereof in a novel manner, including deterioration characteristics as the sensor ages.

DETAILED DESCRIPTION

Prior Art

Figure 1:
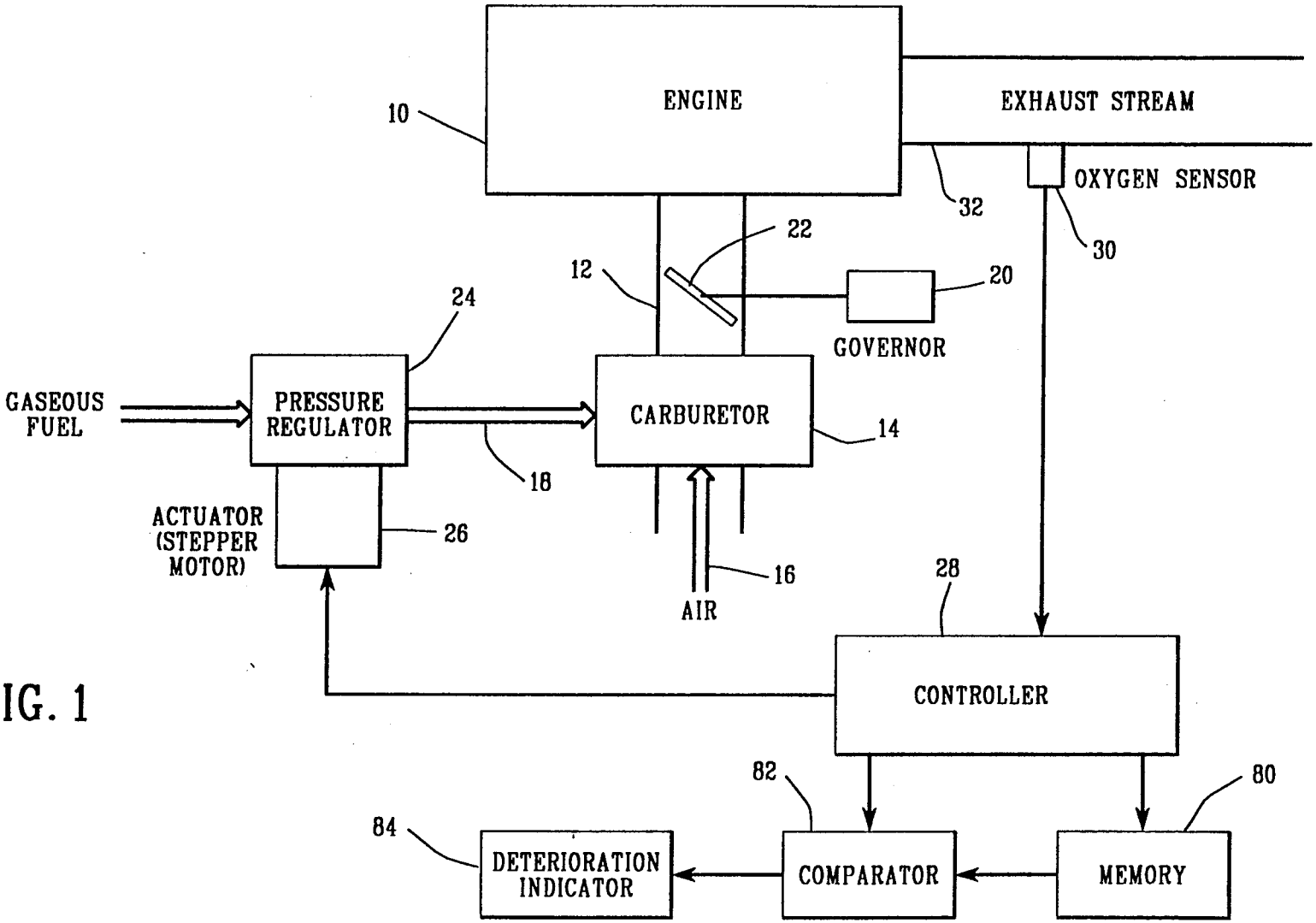
FIG. 1 is a schematic illustration of a system in accordance with the invention.

FIG. 1 shows an internal combustion engine 10 receiving an air/fuel mixture supplied through intake manifold 12 from carburetor 14. The carburetor receives air from air inlet 16 and fuel from fuel inlet 18. A governor 20 controls the position of a valve 22 to control the speed of the engine by controlling the volume of the air/fuel mixture supplied thereto. A pressure regulator 24 controls the pressure of gaseous fuel supplied to the carburetor. The fuel pressure supplied by the regulator to the carburetor is controlled by an actuator 26. In various applications, and in the preferred embodiment of the present invention, actuator 26 is a stepper motor, for example having 0.9° of angular rotation per step, such that the fuel is adjustably supplied in incremental fuel units. Actuator 26 receives signals from a microprocessor based controller 28 which is connected to an oxygen sensor 30 located in exhaust manifold 32 of engine 10.

Oxygen sensor 30 disposed in the exhaust gas stream of engine 10 detects the relative presence of oxygen in the exhaust gases of the engine, and outputs a voltage signal in response thereto. The voltage signal is fed back to controller 28 which controls actuator 26 such that the latter adjusts the air/fuel ratio to in turn maintain a constant feedback voltage from sensor 30. This type of control of the proper air/fuel ratio mixture supplied to the engine provides the type of combustion desired, e.g. rich stoichiometric, lean burn, etc., and also ensures that the proper exhaust gas constituents are transmitted to a downstream catalytic converter, all assuming that sensor 30 remains accurate and continues to output a feedback voltage signal indicative of the relative presence of oxygen in the exhaust gases of the engine.

Figure 2:
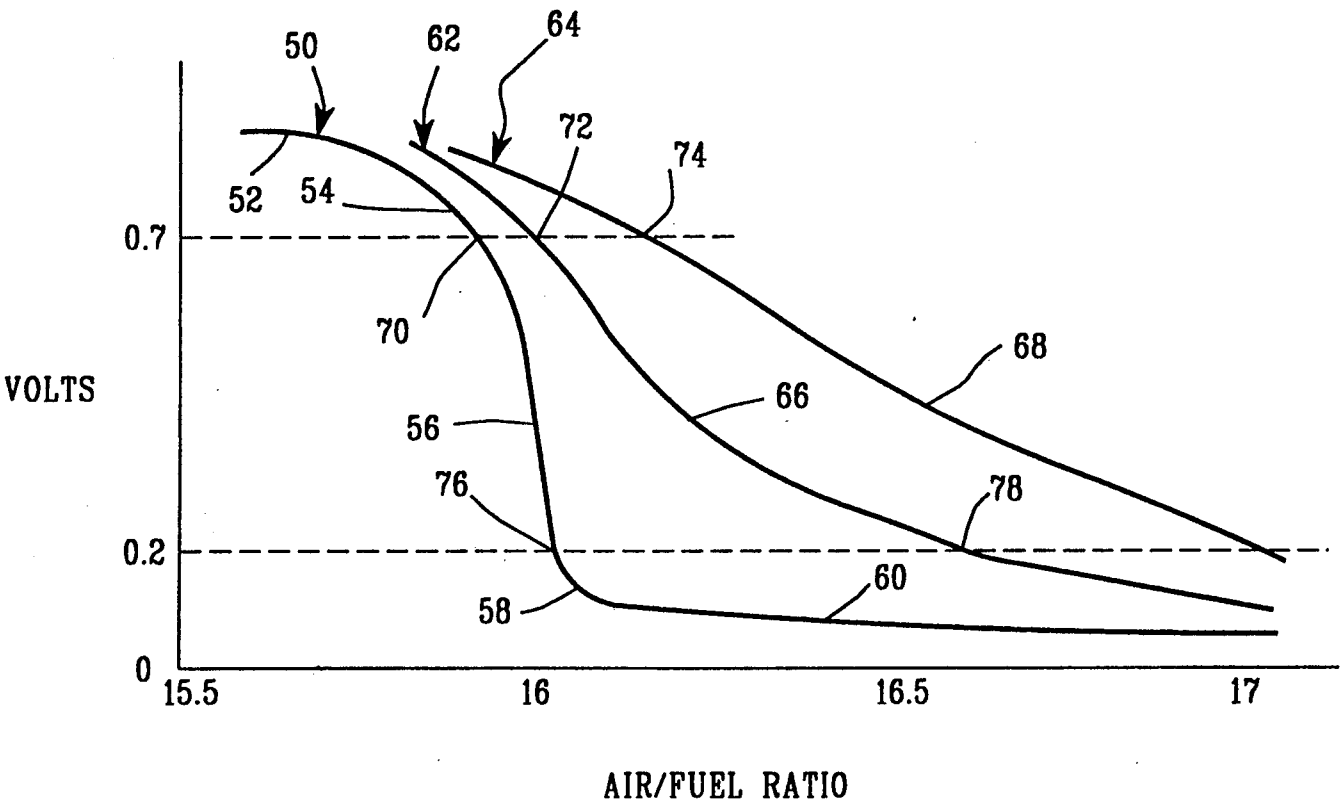
FIG. 2 is a graph showing sensor output voltage versus air/fuel ratio.

FIG. 2 shows the output voltage in volts of sensor 30 as a function of air/fuel ratio, where the ratio is air mass to fuel mass. The sensor in a nondeteriorated condition exhibits a change in output voltage along an initial profile 50 as a function of air/fuel ratio. Profile 50 has an upper plateau 52 transitioning at an upper knee 54 to a downward slope 56 of decreasing voltage with increasing air/fuel ratio, and transitioning at a lower knee 58 to a lower plateau 60. Varying amounts of oxygen passing the oxygen sensor cause the sensor to generate varying amounts of voltage. For example, if there is an abundance of oxygen in the exhaust gases, the sensor generates a smaller voltage, indicating a lean condition where insufficient amounts of fuel are being mixed with air entering the engine. When there is a lack of oxygen passing the oxygen sensor, the latter generates a higher voltage, indicating a richer air/fuel mixture being supplied to the engine.

For rich stoichiometric combustion, i.e. minimizing the amount of oxygen remaining after combustion, it is typical to choose a sensor output voltage slightly below upper knee 54, e.g. 0.7 volts, as the desired feedback voltage set point Controller 28 controls stepper motor actuator 26 to adjust the air/fuel ratio mixture supplied to the engine to maintain a 0.7 volt output from sensor 30. For leaner combustion, a lower voltage is selected as the feedback voltage set point The lower the chosen voltage, the more oxygen remaining in the products of combustion, i.e. the greater $O_2$ on the right side of the above equation.

As sensor 30 ages and deteriorates, it exhibits a change in output voltage as a function of air/fuel ratio along profile 62. As the sensor further ages and deteriorates, it exhibits a change in output voltage as a function of air/fuel ratio along profile 64. Initial slope 56 for a nondeteriorated sensor is steeper than slope 66 of deterioration profile 62, which in turn is steeper than slope 68 of further deterioration profile 64. As the sensor ages, a given output voltage corresponds to leaner and leaner air/fuel ratios. For example, for a nondeteriorated sensor, an output voltage of 0.7 volts corresponds to an air/fuel ratio of about 15.9 as shown at point 70 on profile 50. As the sensor ages, 0.7 volts corresponds to a 16.0 air/fuel ratio as shown at point 72 on profile 62. As the sensor further ages, 0.7 volts corresponds to a 16.2 air/fuel ratio at point 74 on profile 64.

A typical tolerance in air/fuel ratio engine specifications for optimum performance is about ±0.05. The 16.0 air/fuel ratio at point 72 is spaced by a difference of 0.1 from the 15.9 air/fuel ratio at point 70 and hence is outside acceptable tolerance. Thus, when sensor 30 has aged to the profile shown at 62, it needs replacement, otherwise controller 28 will continue to command actuator 26 to supply a 16.0 air/fuel ratio in order to maintain a 0.7 volt output from sensor 30. When the sensor has further aged to the profile shown at 64, an air/fuel ratio of 16.2 is necessary to maintain the 0.7 volt output from sensor 30, which 16.2 ratio at point 74 is even further out of tolerance from the desired ratio at point 70. Thus, if the sensor is not replaced, the air/fuel ratio drifts farther and farther out of tolerance.

Present Invention

In the present invention, a method is provided for detecting deterioration of oxygen sensor 30 disposed in the exhaust gas stream of engine 10. The sensor in a nondeteriorated condition exhibits the noted change in output voltage as a function of air/fuel ratio along profile 50. The sensor in a deteriorated condition exhibits a different change in output voltage as a function of air/fuel ratio, as shown at profile 62. The present method comprises initially counting the number of fuel units required to change the output voltage of a nondeteriorated sensor between first and second voltages, e.g. 0.7 volts and 0.2 volts. The number of fuel units are the number of steps of stepper motor actuator 26 required to change the sensor output voltage from 0.7 volts to 0.2 volts. This initial count is the number of steps or fuel units required to lean the air/fuel mixture from point 70 to point 76 along profile 50, i.e. the number of reduced fuel units necessary to increase the air/fuel ratio from 15.9 at point 70 to 16.0 at point 76. The method further comprises subsequently counting the number of fuel units required to change the output voltage of the sensor between the noted first and second voltages, as the sensor ages, until a subsequent count exceeds the initial count by a given amount, and then providing a deterioration indication in response thereto. If the sensor has aged to profile 62, then the number of reduced fuel units required to change the output voltage of the sensor from 0.7 volts to 0.2 volts will be substantially greater than the noted initial count. This is because a proportionately greater leaning of the air/fuel ratio is required to change the 0.7 volt output of the aged sensor at point 72 to the 0.2 volt output at point 78 along profile 62, i.e. the number of reduced fuel units to go from point 72 to point 78 is greater than the number of reduced fuel units to go from point 70 to point 76. In accordance with the present invention, a deterioration indication is provided when the subsequent count, e.g. fuel units from point 72 to point 78, exceeds the initial count, e.g. fuel units from point 70 to point 76, by a given amount. The number of fuel units are determined by the number of stepper motor steps required to achieve the noted output voltages of sensor 30.

Each of the noted first and second voltages, e.g. 0.7 volts and 0.2 volts, is preferably chosen to be along slope 56 of a new or nondeteriorated sensor. The initially counted number of fuel units required to change the output voltage of a nondeteriorated sensor between the first and second voltages corresponds to a first change in air/fuel ratio, e.g. the 0.1 change between 15.9 at point 70 and 16.0 at point 76. The subsequently counted number of fuel units required to change the output voltage of a deteriorated sensor between the noted first and second voltages corresponds to a second change in air/fuel ratio, e.g. the 0.5 change between 16.0 at point 72 and 16.5 at point 78.

The fuel supplied to the engine during normal engine operation between the noted countings is controlled such that sensor output voltage is maintained at the noted first voltage, e.g. 0.7 volts. As the sensor ages, the air/fuel ratio corresponding to 0.7 volts changes from an initial ratio of 15.9 at point 70 to a subsequent different ratio of 16.0 at point 72, which is outside acceptable tolerance. This change outside acceptable tolerance is detected by the noted step of subsequently counting the number of fuel units required to change the output voltage of the sensor between 0.7 volts and 0.2 volts until such subsequent count exceeds the initial count by a given amount. This indicates a change in output voltage characteristic exhibited by the sensor from profile 50 along slope 56 to profile 62 along slope 66, to in turn indicate the change of air/fuel ratio from 15.9 at point 70 to 16.0 at point 72 outside acceptable tolerance at the noted first voltage of 0.7 volts. For rich stoichiometric combustion, the noted first voltage is selected at the upper portion of slope 56 generally at upper knee 54. For leaner combustion, the noted first voltage is selected along a central portion of slope 56, e.g. at 0.5 volts.

As noted above, sensor 30 has a nondeteriorated condition exhibiting a change in output voltage between the noted first and second voltages along an initial slope 56 as a function of air/fuel ratio. The sensor in further aged and deteriorated conditions exhibits changes in output voltage along further deterioration slopes 66, 68 as a function of air/fuel ratio as the sensor ages. Initial slope 56 is steeper than each of the deterioration slopes. The noted first voltage, e.g. 0.7 volts, is selected along initial slope 56 corresponding to a first air/fuel ratio at point 70 at which it is desired to operate the engine during normal operation. One of the deterioration slopes, e.g. 66, is selected as corresponding at the noted first voltage to a second air/fuel ratio, e.g. at point 72, which is outside acceptable tolerance for normal engine operation. The present method determines when the sensor has aged to the selected deterioration slope by counting the number of fuel units required to change the output voltage of the sensor between the noted first and second voltages, and determining when such count exceeds a given number. When the difference between the air/fuel ratios at points 78 and 72 exceeds the difference between the air/fuel ratios at points 76 and 70 by a given amount, a deterioration indication is provided.

The noted initial count is determined by the number of incremental steps of stepper motor actuator 26 as commanded by controller 28. The initial count provides a base standard number of incremental units of fuel required to change an initial rich stoichiometric mixture at 70 to an initial lean mixture at 76 based upon the oxygen content of exhaust gases as detected by sensor 30. The initial count is stored in memory 80, and is later compared at comparator 82 against subsequent counts which are the subsequently detected number of incremental fuel units required for the sensor to detect a change from rich stoichiometric combustion to lean combustion. Deterioration indicator 84, such as a light or an alarm on the engine and/or a control panel, responds to the comparator and provides an indication of sensor deterioration when the difference between the base standard number of units and the subsequently detected units exceeds a prespecified number.

Figure 3:
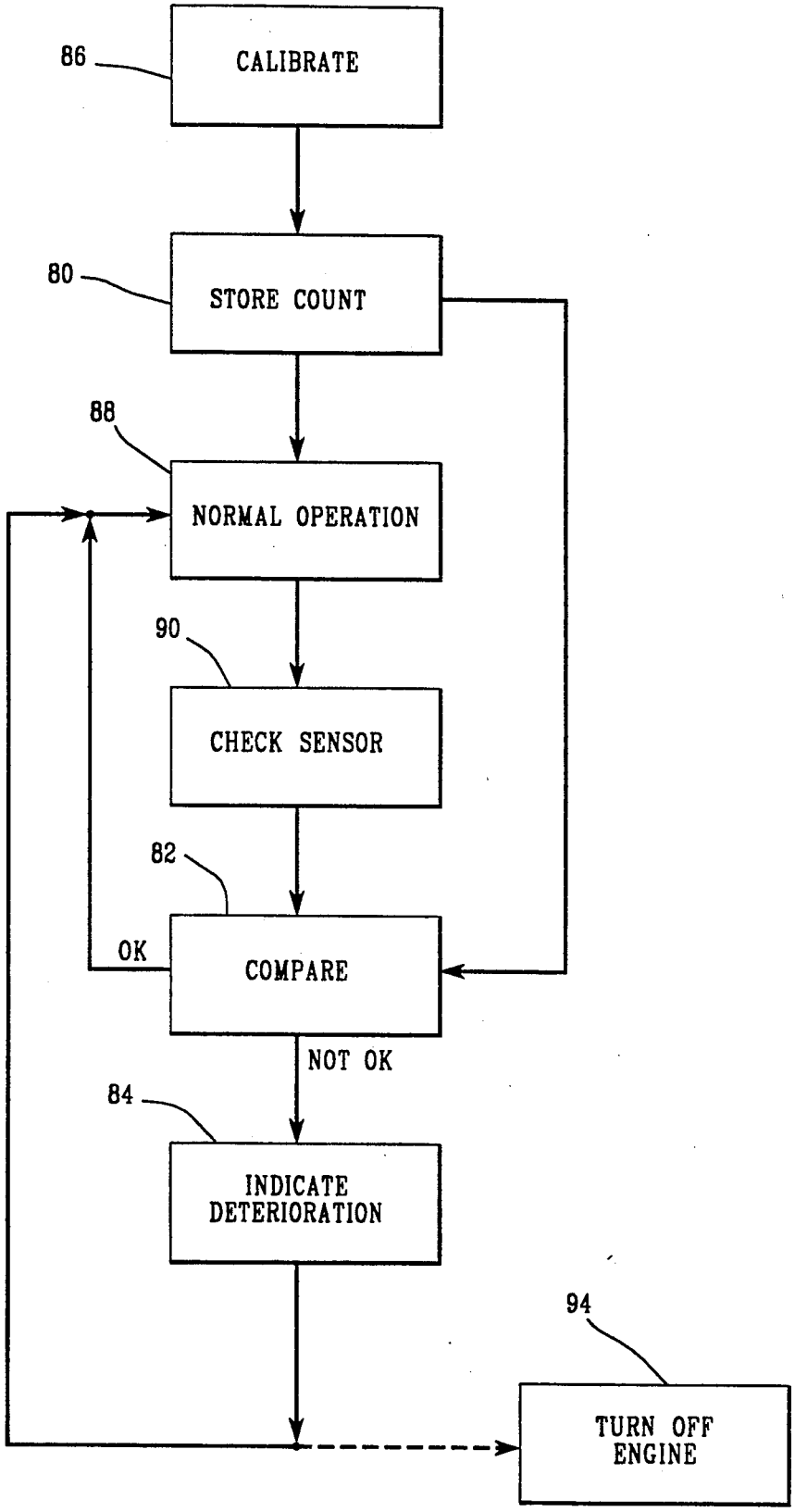
FIG. 3 is a flow chart illustrating operation.

System operation is illustrated in FIG. 3. Microprocessor based controller 28 is programmed to initially calibrate the system at 86 by initially counting the number of fuel units, i.e. stepper motor steps, required to change the sensor output voltage from 0.7 volts to 0.2 volts. This initial count is stored at 80. The engine is then run in accordance with normal operation at 88, wherein controller 28 controls stepper motor actuator 26 to maintain an air/fuel ratio mixture to the engine such that the output voltage of sensor 30 is maintained at 0.7 volts, as above described, and as is standard in the art. The controller is programmed to check the sensor at step 90 at regular periodic intervals, or at increasing frequency with increasing age, or upon manual command. The sensor is checked by counting the number of fuel units, i.e. stepper motor steps, necessary to change the sensor output voltage from 0.7 volts to 0.2 volts, as above described. The subsequent count is compared at 82 against the initial stored count. If the difference is less than a given amount, the sensor is okay, and the system returns to normal operation. If the difference exceeds a given amount, the sensor is not okay, and a deterioration indication is provided at 84. The deterioration indication sounds an alarm or lights a lamp or otherwise audibly or visually indicates at the engine and/or a control panel that the sensor needs to be replaced. In one embodiment, normal engine operation may still be resumed in response to a deterioration indication signal from deterioration indicator 84, as shown in solid line in FIG. 3, or alternatively normal engine operation may be enabled only for a limited time thereafter. Further alternatively, the deterioration indication signal from deterioration indicator 84 may be used to turn off the engine at 94 as shown in dashed line in FIG. 3.

It is recognized that various equivalents, alternatives and modifications are possible within the scope of the appended claims.

I claim:

1. A method for detecting deterioration of an oxygen sensor disposed in the exhaust gas stream of an internal combustion engine receiving an air/fuel mixture, the fuel being adjustably supplied in incremental fuel units, said sensor in a nondeteriorated condition exhibiting a change in output voltage as a function of air/fuel ratio, said sensor in a deteriorated condition exhibiting a different change in output voltage as a function of air/fuel ratio, said method comprising initially counting the number of fuel units required to change the output voltage of a nondeteriorated sensor between first and second voltages, and subsequently counting the number of fuel units required to change the output voltage of said sensor between said first and second voltages, as said sensor ages, until a subsequent count exceeds the initial count by a given amount, and providing a deterioration indication in response thereto.

2. The method according to claim 1 wherein said sensor in said nondeteriorated condition exhibits a change in output voltage as a function of air/fuel ratio along a profile having an upper plateau transitioning at an upper knee to a first downward slope of decreasing voltage with increasing air/fuel ratio, and transitioning at a lower knee to a lower plateau, said sensor in a deteriorated condition exhibiting a change in output voltage along a second downward slope generally from said upper plateau to said lower plateau, said first slope being steeper than said second slope, said method comprising selecting at least one of said first and second voltages to be along said first slope, initially counting the number of fuel units required to change the output voltage of a nondeteriorated sensor between said first and second voltages, corresponding to a first change in air/fuel ratio, and subsequently counting the number of fuel units required to change the output voltage of said sensor between said first and second voltages, as said sensor ages, until such subsequent count exceeds said initial count by said given amount, corresponding to a second change in air/fuel ratio greater than said first change.

3. The method according to claim 2 comprising selecting said first voltage to be along said first slope, and controlling the fuel supplied to said engine during normal engine operation between said countings such that said sensor output voltage is maintained at said first voltage, such that as said sensor ages, the air/fuel ratio corresponding to said first voltage changes from an initial ratio to a subsequent different ratio outside acceptable tolerance, and comprising detecting said change outside acceptable tolerance by said step of subsequently counting the number of fuel units required to change the output voltage of said sensor between said first and second voltages until such subsequent count exceeds said initial count by said given amount, indicating a change in the output voltage characteristic exhibited by said sensor from said first slope to said second slope to in turn indicate the change of air/fuel ratio outside said acceptable tolerance at said first voltage.

4. The method according to claim 3 comprising selecting said first voltage at the upper portion of said first slope generally at said upper knee.

5. The method according to claim 3 comprising selecting said first voltage generally along a central portion of said first slope.

6. The method according to claim 1 wherein said sensor in a nondeteriorated condition exhibits a change in output voltage along a first slope as a function of air/fuel ratio, said sensor in a deteriorated condition exhibits a change in output voltage along a second slope as a function of air/fuel ratio, said first slope being steeper than said second slope, and comprising selecting each of said first and second voltages to be along said first slope.

7. A method for detecting deterioration of an oxygen sensor outside given tolerance limits during engine operation, said sensor being disposed in the exhaust gas stream of an internal combustion engine receiving an air/fuel mixture, the fuel being adjustably supplied in incremental fuel units, said sensor in a nondeteriorated condition exhibiting a change in output voltage between first and second voltages along an initial slope as a function of air/fuel ratio, said sensor in further aged and deteriorated conditions exhibiting changes in output voltage along further deterioration slopes as a function of air/fuel ratio as said sensor ages, said initial slope being steeper than each of said deterioration slopes, said method comprising selecting said first voltage along said initial slope corresponding to a first air/fuel ratio at which it is desired to operate said engine during normal operation, selecting one of said deterioration slopes corresponding at said first voltage to a second air/fuel ratio which is outside acceptable tolerance for said normal engine operation, determining when said sensor has aged to said selected deterioration slope by counting the number of fuel units required to change the output voltage of said sensor between said first and second voltages, and determining when said count exceeds a given number.

8. A method for detecting deterioration of an oxygen sensor disposed in the exhaust gas stream of an internal combustion engine receiving an air/fuel mixture, said sensor in a nondeteriorated condition exhibiting a change in output voltage along a first slope as a function of air/fuel ratio, said sensor in a deteriorated condition exhibiting a change in output voltage along a second slope as a function of air/fuel ratio, said method comprising selecting first and second voltages along said first slope corresponding to respective air/fuel ratios having a first difference therebetween, subsequently detecting when a second difference between air/fuel ratios corresponding respectively to said first and second voltages changes from said first difference by a given amount, and providing a deterioration indication in response thereto.

9. The method according to claim 8 wherein said first slope is steeper than said second slope, and comprising providing said deterioration indication when said second difference is greater than said first difference by said given amount.

10. The method according to claim 9 wherein said first and second voltages along said first slope correspond respectively to first and second air/fuel ratios, said first and second voltages along said second slope correspond respectively to third and fourth air/fuel ratios, and comprising providing said deterioration indication when the difference between said third and fourth air/fuel ratios exceeds the difference between said first and second air/fuel ratios by said given amount.

11. An oxygen sensor deterioration detection system including:

an oxygen sensor disposed in the exhaust gas stream of an internal combustion engine for detecting the relative presence of oxygen in the exhaust gases of the engine;

means for supplying a specified ratio mixture of air and fuel to the engine;

actuator means for adjustably controlling the specified ratio of air and fuel delivered by said supply means, said actuator means including a device for delivering incremental units of fuel to said supply means;

means initially actuatable for detecting and storing a base standard number of incremental units of fuel required to change an initial rich stoichiometric mixture to an initial lean mixture based upon the oxygen content of exhaust gases as detected by said sensor;

means selectively actuatable for subsequently detecting the number of incremental fuel units required for said sensor to detect a change from rich stoichiometric combustion to lean combustion; and means for comparing the base standard number of units to the number of subsequently detected units and providing an indication of sensor deterioration in the event the difference exceeds a prespecified number

12. The system according to claim 11 wherein:

said sensor in a deteriorated condition exhibits a change in output voltage along a first slope as a function of air/fuel ratio;

said oxygen sensor in a deteriorated condition exhibits a change in output voltage along a second slope as a function of air/ fuel ratio;

said first slope is steeper than said second slope;

and comprising means initially counting the number of fuel units required to change the output voltage of a nondeteriorated sensor between first and second voltages along said first slope, corresponding to a first change in air/fuel ratio, and storing such initial count, and subsequently counting the number of fuel units required to change the output voltage of said sensor between said first and second voltages, as said sensor ages, until such latter count exceeds said initial count by a given amount, corresponding to a second change in air/fuel ratio corresponding to a voltage change along said second slope, said comparator means comparing said initial stored count and said latter count, and a deterioration indicator responsive to said comparator means for indicating sensor deterioration when said latter count exceeds said initial stored count by said given amount.

* * * * *